US011833702B2

(12) United States Patent
Scimone et al.

(10) Patent No.: US 11,833,702 B2
(45) **Date of Patent: *Dec. 5, 2023**

(54) DEBURRING CUTTER

(71) Applicant: Slice, Inc., Sunny Isles, FL (US)

(72) Inventors: Thomas Scimone, Campbell, CA (US); Scot Herbst, Santa Cruz, CA (US); Robert Joseph Gallegos, Fremont, CA (US); William Whitfield Hunter, Santa Cruz, CA (US)

(73) Assignee: Slice, Inc., Sunny Isles, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/589,367

(22) Filed: Jan. 31, 2022

(65) Prior Publication Data

US 2022/0152850 A1 May 19, 2022

Related U.S. Application Data

(63) Continuation of application No. 16/841,505, filed on Apr. 6, 2020, now Pat. No. 11,235,479.

(51) Int. Cl.

| | |
|---|---|
| ***B26B 5/00*** | (2006.01) |
| ***B26B 29/02*** | (2006.01) |
| ***B26B 1/10*** | (2006.01) |

(52) U.S. Cl.

CPC ..... *B26B 5/003* (2013.01); *B26B 1/10* (2013.01); *B26B 29/02* (2013.01)

(58) Field of Classification Search

None

See application file for complete search history.

(56) References Cited

U.S. PATENT DOCUMENTS

| | | | | |
|---|---|---|---|---|
| 4,899,443 | A * | 2/1990 | Beermann | B26B 5/003 30/162 |
| 8,959,778 | B2 * | 2/2015 | Baid | A61B 17/3213 30/151 |
| 10,427,310 | B2 * | 10/2019 | Scimone | B26B 5/003 |
| 10,478,977 | B2 * | 11/2019 | Rohrbach | B26B 1/08 |
| 10,525,605 | B2 * | 1/2020 | Scimone | B26B 29/025 |
| 11,235,479 | B2 * | 2/2022 | Scimone | B26B 5/003 |
| 2014/0165409 | A1 * | 6/2014 | Scimone | B26B 1/08 30/162 |
| 2018/0001489 | A1 * | 1/2018 | Scimone | B26B 5/00 |
| 2018/0290315 | A1 * | 10/2018 | Scimone | B26B 5/00 |
| 2022/0105647 | A1 * | 4/2022 | Nelson | B26B 5/00 |
| 2022/0152850 | A1 * | 5/2022 | Scimone | B26B 5/003 |

* cited by examiner

*Primary Examiner* — Hwei-Siu C Payer

(74) *Attorney, Agent, or Firm* — McCarter & English, LLP; James M. Smedley; Alex Korona

(57) ABSTRACT

The present invention generally relates to cutting devices. Specifically, the present invention relates to a deburring cutter device. In some examples, the deburring cutter includes a handle module, a blade, and a blade cover. In an exemplary embodiment of the present invention, the handle module includes a blade holder configured with a blade cavity having walls which are adapted to reversibly secure the blade, allowing the blade to be selectively removed.

15 Claims, 4 Drawing Sheets

DEBURRING CUTTER

CROSS-REFERENCE TO RELATED APPLICATIONS

This application is a continuation of U.S. patent application Ser. No. 16/841,505 filed on Apr. 6, 2020, now U.S. Pat. No. 11,235,479, and entitled DEBURRING CUTTER, which is hereby incorporated by reference in its entirety.

FIELD OF THE INVENTION

The present invention generally relates to cutting devices. Specifically, the present invention relates to a deburring cutter device. In some examples, the deburring cutter includes a handle module, a blade, and a blade cover. In an exemplary embodiment of the present invention, the handle module includes a blade holder configured with a blade cavity having walls which are adapted to reversibly secure the blade, allowing the blade to be selectively removed.

BACKGROUND

Deburring blade devices are commonly used for chamfering, deburring or de-flashing various materials such as plastic and aluminum. Such deburring blade devices generally comprise a handle component and a blade component. Some deburring cutters have removable or replaceable blades. Generally, such cutters utilize blades having tapered top and bottom sides, for example, blades which utilize Morse taper configurations, to lock a selected tapered blade into a corresponding cavity in the handle component of the cutter device. These devices typically require a secondary tool to enable a user to selectively remove the blade from the handle component. For example, such cutters may require a separate "key" or similar apparatus to unlock and remove a blade from the blade cavity. In such scenarios, the "key" must be inserted into a hole in the blade holder to apply a force or pressure on one or more edges of the blade to slightly eject the blade such that a user may grip and pull on an exterior portion of the blade to remove the blade from within the blade holding cavity. This procedure is often awkward, complicated, or unsafe.

Therefore, there is a need in the art for a deburring cutting device that securely holds a replaceable blade and provides a convenient means for replacing a blade. Further, there is a need for a deburring cutter device that is sufficiently durable to maintain a consistent holding power for each newly replaced blade. These and other features and advantages of the present invention will be explained and will become obvious to one skilled in the art through the summary of the invention that follows.

SUMMARY OF THE INVENTION

Accordingly, it is an aspect of the present invention to provide a deburring cutting device which is configured to securely hold a replaceable blade. Furthermore, it is an aspect of the present invention to provide a deburring cutting device whose blade may be easily exchanged or replaced, for example, without the need for extra tools.

According to an embodiment of the present invention, a deburring cutter device includes: a blade, a handle module comprising a locking sleeve and a blade holder configured to reversibly secure a blade. The blade holder may comprise a blade cavity, a tension component, and an actuator release. In some embodiments, the cutting device additionally includes a blade cover.

BRIEF DESCRIPTION OF THE DRAWINGS

Accompanying this written specification is a collection of drawings of exemplary embodiments of the present invention. One of ordinary skill in the art would appreciate that these are merely exemplary embodiments, and additional and alternative embodiments may exist and still be within the spirit of the invention as described herein.

DETAILED DESCRIPTION

The present invention generally relates to deburring cutter devices configured to reversibly secure blades. For example, at least some exemplary embodiments of the present invention relate to deburring cutter devices having a handle module comprising a locking sleeve and blade holder configured to reversibly secure a blade, a blade, and a blade cover.

According to an embodiment of the present invention, the deburring cutter device may comprise a blade and a handle module comprising a locking sleeve configured to receive a blade holder comprising a blade cavity, a tension component, and an actuator release. Certain embodiments of the present invention may include fewer components or additional components depending on the utilization and purpose for the deburring cutter device.

Figure 1:
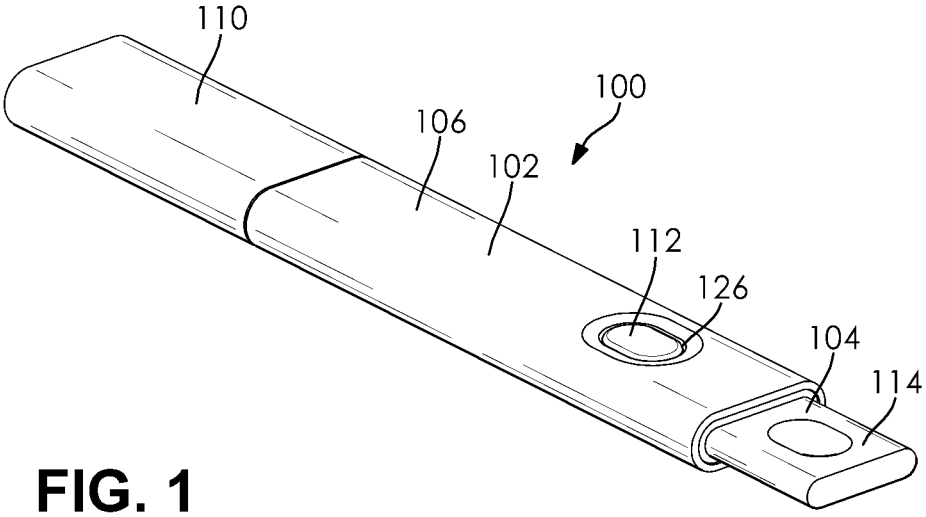
FIG. 1 shows a perspective view of a deburring cutter device in accordance with an embodiment of the present invention.

FIG. 1 shows a perspective view of a deburring cutter device in accordance with an embodiment of the present invention. As shown in FIG. 1, according to embodiments of the present invention, the cutting device 100 may be comprised of a handle module 102 comprising a blade holder 104 and a locking sleeve 106, a blade 108, and a blade cover 110. The blade holder 104 may be configured with an actuator release 112, a grip tab 114, and a blade cavity 116. The actuator release 112 may be configured to move from a first position to a second position, wherein the first position of the actuator release 112 may correspond to a locked actuator release position and the second position of the actuator release 112 may correspond to an unlocked actuator release position.

Figure 2:
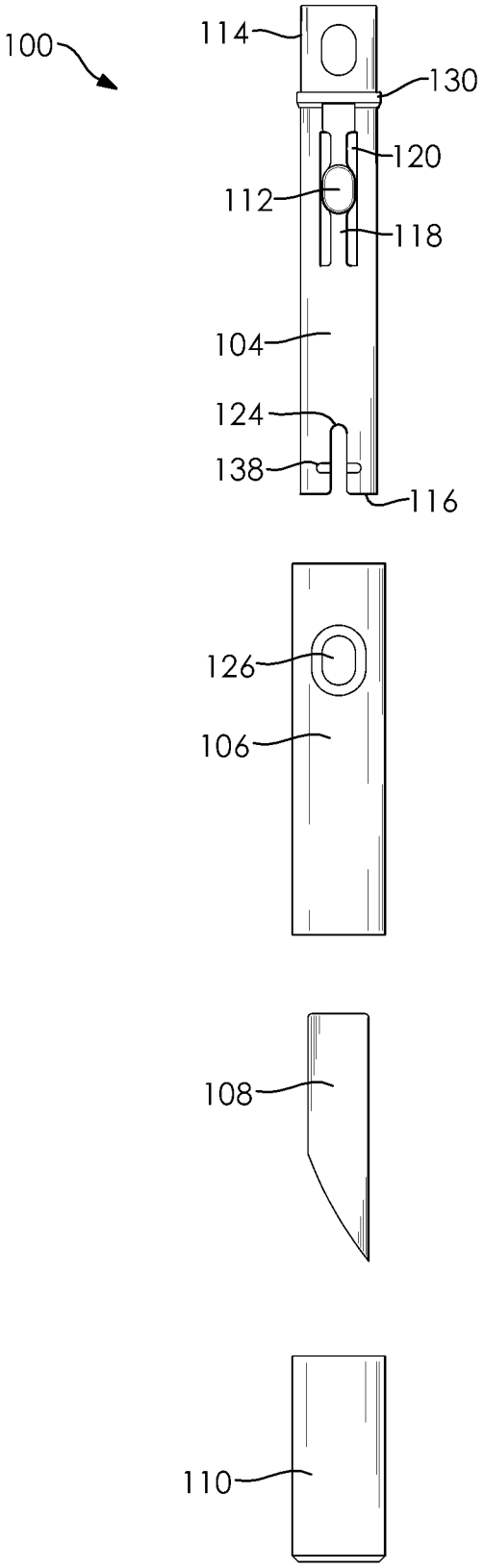
FIG. 2 shows an exploded view of a deburring cutter device in accordance with an embodiment of the present invention.
Figure 3:
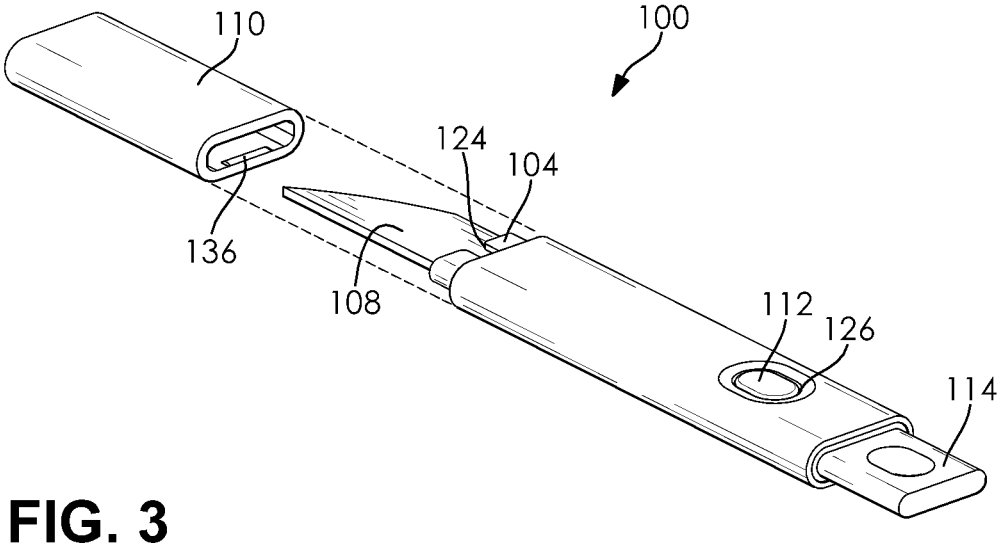
FIG. 3 shows a perspective view of a deburring cutter device with the blade cover removed in accordance with an embodiment of the present invention.
Figure 7:
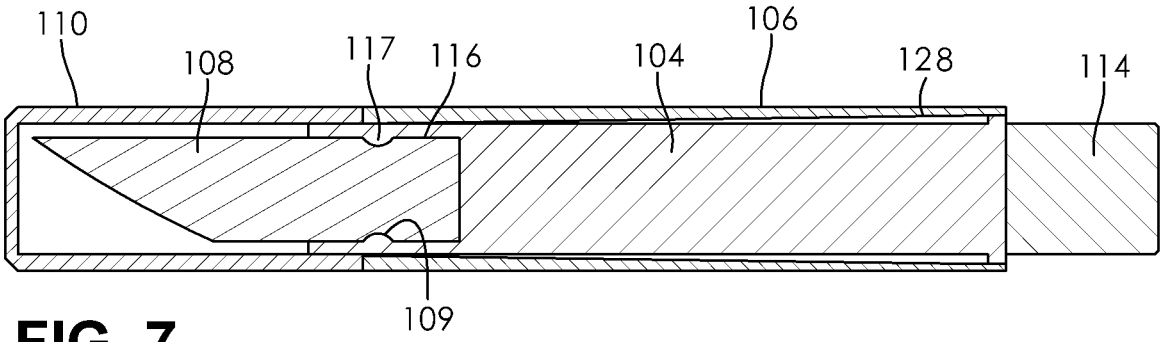
FIG. 7 shows a cross sectional view of a deburring cutter device having locking protrusions disposed within in the blade cavity in accordance with an embodiment of the present invention.

FIG. 2 shows an exploded view of a deburring cutter device in accordance with an embodiment of the present invention. FIG. 3 shows a perspective view of a deburring cutter device with the blade cover removed to reveal the blade within the blade holder in accordance with an embodiment of the present invention. As shown in FIGS. 2 and 3, according to embodiments of the present invention, the blade holder 104 of the handle module 102 may be configured to reversibly retain a blade 108. The blade holder 104 may be formed of a substantially resilient material and may comprise a first end having a blade cavity 116 and a second end having a grip tab 114. The interior of the blade cavity 116 may comprise walls which are configured to substantially abut at least a portion of the sides of a blade 108 to reversibly hold a blade 108. In some embodiments, the blade cavity 116 is configured to retain a blade 108 having a base with substantially parallel opposing sides. In some examples, the blade cavity 116 may be configured to pressure fit the base of a blade 108. In some examples, the blade cavity 116 may be configured to friction fit a blade 108. As shown in FIG. 7, in some embodiments, the blade cavity 116 may include one or more locking protrusions 117 which correspond to one or more mating indentations 109 in the blade 108 and are configured to secure the blade 108 to the handle module 102. In the depicted embodiment, the locking protrusions 117 are rounded, however, in some embodiments, the locking protrusions 117 may be formed in a plurality of suitable shapes, including but not limited to, triangular, squared, hexagonal or octagonal. In some embodiments, the blade cavity 116 may include one or more relief notches 124. In some examples, the blade holder 104 includes a sleeve stop 130 placed at a predetermined position and configured as a stop for the locking sleeve 106, to prevent the locking sleeve 106 from moving past the predetermined position. One of ordinary skill in the art would appreciate that there are numerous configurations and materials that might be used for the blade holder and the blade cavity, and embodiments of the present invention are contemplated for use with any such material or configuration.

Figure 4:
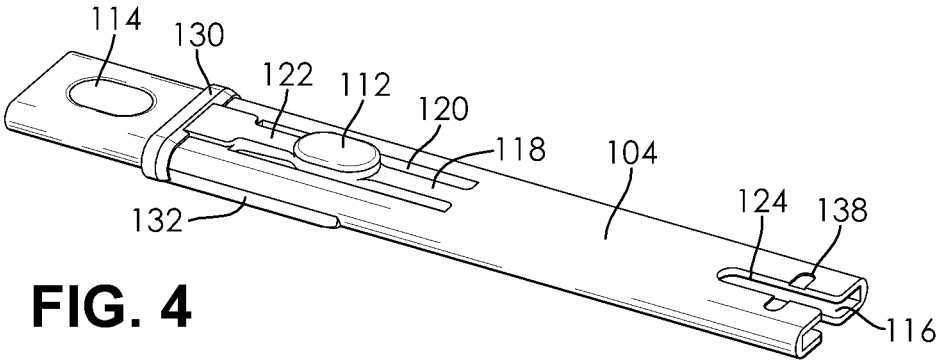
FIG. 4 shows a top perspective view of a blade holder of a deburring cutter device in accordance with an embodiment of the present invention.
Figure 5:
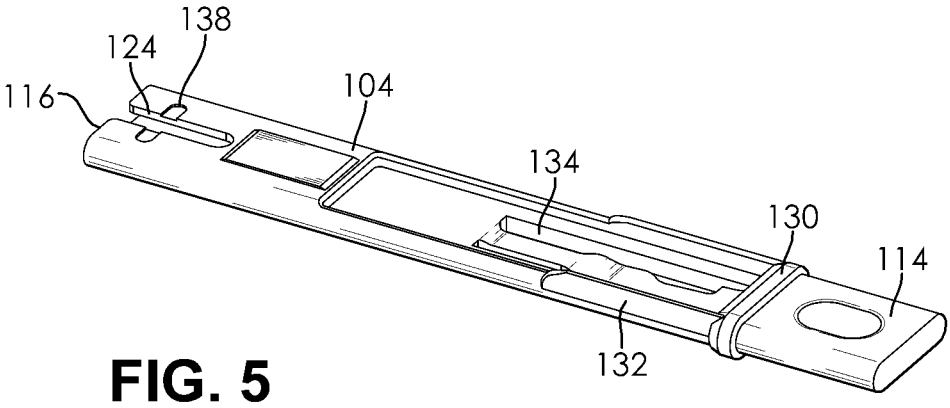
FIG. 5 shows a bottom perspective view of a blade holder of a deburring cutter device in accordance with an embodiment of the present invention.

FIGS. 4 and 5 respectively show top and bottom perspective views of a blade holder of a deburring cutter device in accordance with an embodiment of the present invention. As shown in FIGS. 4 and 5, according to embodiments of the present invention, the blade holder 104 may include a tension component 118 and an actuator release 112 disposed between its first and second ends. The tension component 118 may be configured to bias the actuator release 112 to the locked actuator release position and may be compressed to move the actuator release 112 from the locked position to the unlocked position to permit the movement of the locking sleeve 106. The tension component 118 may comprise a spring, for example, a leaf spring or a coil spring. In some embodiments, the tension component 118 may comprise an elongate flexible member 122 disposed between one or more elongate openings 120. In some examples, the elongate flexible member 122 is configured to bias the actuator release 112 to the locked actuator release position. In some examples, the blade holder 104 includes a recess 134 configured to receive a bottom side of the one or more of the tension component 118 and the actuator release 112. One of ordinary skill in the art would appreciate that there are numerous configurations and materials that might be used for the tension component and actuator release, and embodiments of the present invention are contemplated for use with any such material or configuration.

According to embodiments of the present invention, the blade holder 106 may include one or more protruding guides 132 configured to engage with one or more blade holder tracks 128 disposed on the locking sleeve 106 to enable the movement of the locking sleeve 106 relative to the blade holder 104. In some examples, the locking sleeve 106 includes the protruding guides and the blade holder 104 includes the tracks to enable the movement of the locking sleeve 106 relative to the blade holder 104.

According to embodiment of the present invention, the blade holder 106 may include a grip tab 114. The grip tab 114 may be configured with a textured portion for convenient gripping or holding. In some examples, the grip tab 114 is configured to extend a predetermined distance past the locking sleeve 106 when the blade holder 104 is received within the locking sleeve 106, to enable a user to grip the blade holder 106 and slide or otherwise sufficiently disengage the locking sleeve 106 from the blade holder 106.

According to embodiments of the present invention, the cutting device 100 may include a blade cover 110 configured to selectively cover the blade 108. In some embodiments, the blade cover 110 includes a locking mechanism. In some embodiments, the locking mechanism of the blade cover 110 includes a protruding portion 136 configured to engage with a notch portion 138 in the blade holder 104 to selectively cover the blade 108. In some examples, the blade cover 110 may be removed from atop the blade 108 and may be relocated to engage with the grip tab 114 such that the blade cover 110 may be stowed safely, for example, without getting misplaced, while the cutting device 100 is in use by a user.

Figure 6:
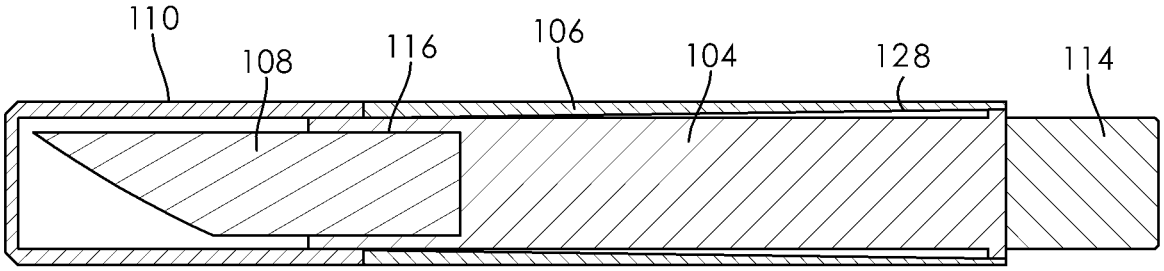
FIG. 6 shows a cross sectional view of a deburring cutter device in accordance with an embodiment of the present invention.

FIG. 6 shows a cross sectional view of a deburring cutter device in accordance with an embodiment of the present invention. As shown in the depicted example, according to embodiments of the present invention, the locking sleeve 106 of the handle module 102 may be configured to engage with the blade holder 104 in manner which causes the blade cavity 116 of the blade holder 104 to tightly hold the blade 108. In some embodiments, the locking sleeve 106 is configured to reversibly receive the blade holder 104. In some examples, the locking sleeve 106 may be configured as a substantially hollow channel having inner walls which create a chamber adapted to reversibly retain the blade holder 104. As further shown in the exemplary embodiment depicted in FIG. 7, the locking sleeve 106 may be configured with one or more interior walls which are angled, for example, at a one degree angle relative to the exterior walls of the blade holder 104, such that the insertion of the blade holder 104 into the locking sleeve 106 causes the angled interior walls of the locking sleeve 106 to create a compression fit against the blade holder 104, exerting a force on the blade holder 104 and its blade cavity 116 to secure the blade 108 in place within the blade cavity 116. In some examples, the locking sleeve 106 is configured to slidably engage with the blade holder 104. The locking sleeve 106 may include one or more blade holder tracks 128 configured as a path to direct the movement of the blade holder 104 within the locking sleeve 106. The locking sleeve 106 may include an actuator aperture 126. In some embodiments, the actuator aperture 126 is configured to substantially correspond in shape, size and orientation with the actuator release 112. For example, if the actuator release 112 is formed in the shape of an oval, as shown in some of the exemplary embodiments, the actuator aperture 126 may also be formed in the shape of an oval, substantially corresponding in size and orientation of the actuator release 112.

According to embodiments of the present invention, the locking sleeve 106 is configured to engage with the blade holder 104 such that the blade cavity 116 engages with the one or more sides of a replaceable blade to impart a compression or pressure fit on the blade holder 104 and its blade cavity 116 to secure the blade 108 in place within the blade cavity 116. For example, the locking sleeve 106 may be configured with angled interior walls such that the insertion of the blade holder 104 into the locking sleeve 106 causes the angled interior walls to create a compression fit against the blade holder 104, exerting a force on the blade holder 104 and its blade cavity 116 to secure the blade 108 in place within the blade cavity 116.

According to an embodiment of the present invention, a blade 108 having a top or "spine" side opposing a bottom or "belly" side may be disposed within the blade holder 104. In some embodiments, the blade 108 may be removably engaged with the blade holder 104. In some embodiments, the blade 108 may be elongated and have a first end with a cutting section and a second end with a base section. In some embodiments, the top side of the base section is substantially parallel to the bottom side of the base section. In some embodiments, the blade cavity 116 of the blade holder 106 may be configured to receive and tightly hold the base section of the blade 108.

According to an embodiment of the present invention, the cutting section of the blade may take any one of numerous forms suitable for use in a cutting device, such as trapezoidal, hooked, rectangular, and segmented for snap-off (for example, with one or more segments that can be removed from the blade to expose a fresh cutting edge). The cutting edge of the blade may take any one of numerous different configurations of cutting edges, including straight and serrated. In the depicted embodiment, the cutting edge of the blade has a concave profile. In some embodiments, the cutting edge of the blade may have a convex profile. The blade may be made from any suitable material, including, but not limited to, metal, ceramic, or any combination thereof. One of ordinary skill in the art would appreciate that there are numerous configurations and materials that might be used for the blade, and embodiments of the present invention are contemplated for use with any such material or configuration.

In some examples, the locking sleeve is configured to engage with the blade holder to tighten the hold of the blade cavity on the blade. For example, the locking sleeve may exert a force on the blade holder to push the outer walls of the blade cavity towards a central point of the blade cavity thereby compressing the inner walls of the blade cavity inward. In some scenarios, the locking sleeve and the blade holder engage with each other to create a compression or clamping system in which the engagement of the locking sleeve with the blade holder causes the inner walls of the blade cavity to clamp a blade inserted into the blade cavity to hold the blade with a tight compression or pressure fit. In some examples, the locking sleeve is configured to narrow the relief notches of the blade cavity to compress the walls of the blade cavity to tightly hold a blade inserted in the blade cavity. In some scenarios, the compression fit of the blade cavity on the blade when the locking sleeve is engaged with the blade holder prevents the unintended removal of the blade from within the blade cavity.

In an exemplary usage scenario, to remove the blade, a user may compress the actuator release to disengage the locking sleeve from the blade holder. In some examples, this action will insert the actuator release into the actuator aperture, such that the lateral movement of the actuator release is not blocked by the actuator aperture, thereby permitting the movement of the locking sleeve relative to the blade holder, and enabling the user to disengage the locking sleeve from the blade holder by, for example, sliding the locking sleeve away from the blade cavity such that the interior walls of the blade cavity no longer compression or pressure the inserted blade.

According to an embodiment of the present invention, the blade holder may be configured to engage with a removable/exchangeable blade, and may additionally be configured with a friction means to maintain friction sufficiently when the blade is unlocked, for example, when the locking sleeve is unlocked from the blade holder, to prevent the blade from slipping out, but allow the blade to be pulled out or inserted easily. For example, such a friction means may take the form of one or more walls of a blade cavity configured to make contact with one or more of the sides of a blade with pressure high enough to prevent slippage but low enough to allow removal and insertion of the blade when the locking sleeve is unlocked from the blade holder.

According to embodiments of the present invention, the blade that is used may be constructed from a ceramic material that is capable of withstanding extended use without becoming dull or unusable. Ceramic materials appropriate for such construction include, but are not limited to, Zirconium Oxide. One of ordinary skill in the art would appreciate that there are numerous ceramic materials that could be utilized with embodiments of the present invention.

According to an embodiment of the invention, one or more of the blade holder, the locking sleeve, or any parts thereof, may be formed from a suitable thermoplastic material, which may include, for example, Acrylanitrile Butadiene Styrene (ABS), Polycarbonate (PC), Mix of ABS and PC, Acetal (POM), Acetate, Acrylic (PMMA), Liquid Crystal Polymer (LCP), Mylar, Polyamid-Nylon, Polyamid-Nylon 6, Polyamid-Nylon 11, Polybutylene Terephthalate (PBT), Polycarbonate (PC), Polyetherimide (PEI), Polyethylene (PE), Low Density PE (LDPE), High Density PE (HDPE), Ultra High Molecular Weight PE (UHMW PE), Polyethylene Terephthalate (PET), PolPolypropylene (PP), Polyphthalamide (PPA), Polyphenylenesulfide (PPS), Polystyrene (PS), High Impact Polystyrene (HIPS), Polysulfone (PSU), Polyurethane (PU), Polyvinyl Chloride (PVC), Chlorinated Polyvinyl chloride (CPVC), Polyvinylidenefluoride (PVDF), Styrene Acrylonitrile (SAN), Teflon TFE, Thermoplastic Elastomer (TPE), Thermoplastic Polyurethane (TPU), Engineered Thermoplastic Polyurethane (ETPU), or any combination thereof.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A cutting device comprising:

a blade holder member having a compressible blade cavity adapted to receive at least a portion of a blade, wherein the blade cavity is formed from a single piece of material and has a top half that encloses over a top edge of the blade and a bottom half that encloses over a bottom edge of the blade; and a locking sleeve defining an internal hollow having one or more interior walls that are angled to taper the internal hollow between a first end and a second end of the locking sleeve, wherein the first end of the locking sleeve is configured to compress the top and bottom halves of the blade cavity against the top and bottom edges of the blade disposed in the blade cavity.

2. The cutting device of claim 1, wherein the blade holder member further comprises an actuator release protruding from a surface of the blade holder member.

3. The cutting device of claim 2, wherein an actuator release opening is formed in the locking sleeve to receive the actuator release.

4. The cutting device of claim 1, wherein the blade holder member further comprises a pair of elongated relief notches formed on an edge portion of the blade cavity.

5. The cutting device of claim 4, wherein the pair of elongated relief notches define a split between the top and bottom halves of the blade cavity.

6. The cutting device of claim 5, wherein the split defines a gap between the top and bottom halves of the blade cavity that narrows as the locking sleeve compresses around the blade cavity.

7. A cutting device comprising:

a blade holder formed with a protruding actuator release and a compressible blade cavity configured to receive a blade, and a locking sleeve formed as a hollow channel having one or more interior sidewalls which taper between a first interior portion and a second interior portion of the locking sleeve, the locking sleeve comprising an opening configured to receive the actuator release of the blade holder and being adapted to travel along and impart a compression force on at least a portion of the blade cavity to selectively fasten the blade to the blade cavity;

wherein the actuator release prevents movement of the locking sleeve relative to the blade cavity to selectively secure the blade in the blade cavity.

8. The cutting device of claim 7, wherein the locking sleeve is movable along the blade holder to at least a first locking sleeve position wherein the locking sleeve imparts a compression force on a portion of the blade holder to secure a portion of the blade to the blade cavity.

9. The cutting device of claim 7, wherein the locking sleeve is separable from the blade holder to permit release of the blade from within the blade cavity.

10. A cutting device comprising:

an elongate blade holder member configured with a compressible blade cavity comprising interior walls and one or more relief notches, at least a portion of the interior walls adapted to abut at least a portion of a base section of a blade; and a locking sleeve formed as a hollow channel having one or more interior sidewalls which taper between a first interior portion and a second interior portion of the locking sleeve, the locking sleeve adapted to travel along and impart a compression force on at least a portion of the blade cavity to selectively secure the blade to the blade cavity; and wherein the blade holder member is formed with an actuator release configured to engage with the locking sleeve to selectively lock the locking sleeve in a predetermined locked position relative to the blade holder member.

11. The cutting device of claim 10, wherein the locking sleeve is adapted to receive the elongate blade holder member to narrow the one or more relief notches and move the blade cavity interior walls to secure the base section of the blade to the blade cavity.

12. The cutting device of claim 10, wherein the first interior portion of the locking sleeve hollow channel is adapted to compress the one or more relief notches to apply pressure on the base section of the blade disposed between the interior walls of the blade cavity.

13. The cutting device of claim 10, wherein compression of the blade cavity interior walls prevents the unintended removal of the blade from within the blade cavity.

14. The cutting device of claim 10, wherein the locking sleeve is configured to slidably engage with the blade holder member.

15. The cutting device of claim 10, wherein the actuator release disposed on the blade holder member protrudes through an opening disposed on the locking sleeve to prevent movement of the locking sleeve relative to the blade cavity thereby securing the blade in the blade cavity.

* * * * *